United States Patent [19]

Simonseth

[11] 4,433,839

[45] Feb. 28, 1984

[54] BASKETBALL RIM ASSEMBLY

[76] Inventor: John Simonseth, 18936 11th Ave. NE., Seattle, Wash. 98155

[21] Appl. No.: 361,795

[22] Filed: Mar. 25, 1982

[51] Int. Cl.[3] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 3,025,058 | 3/1962 | Brumfield | 273/1.5 R |
| 4,285,518 | 8/1981 | Pearo | 273/1.5 R |
| 4,320,896 | 3/1982 | Engle et al. | 273/1.5 R |
| 4,348,022 | 9/1982 | O'Donnell | 273/1.5 R |
| 4,377,283 | 3/1983 | Mahoney | 273/1.5 R |

OTHER PUBLICATIONS

Sports Illustrated 12-1981, Photograph & Exr's sketch thereof.

Slam Dunk Rim, Inc., Advertising & Sales Circular, 4-1978.

*Primary Examiner*—Paul E. Shapiro

*Attorney, Agent, or Firm*—Hughes, Barnard & Cassidy

[57] ABSTRACT

A basketball rim assembly especially adapted to relieve forces which normally are imparted to the backboard of conventional basketball rim assemblies. There is a rim of conventional configuration mounted to a support plate which fits against the forward face of the backboard. There is a rear support plate on the backside of the backboard fixedly attached to the front plate. This rear plate in turn transmits loads exerted thereon into a base frame structure. Additionally, the rim is provided with a release mechanism which permits it to rotate downwardly from its horizontal position when an impact load of sufficient magnitude is exerted on the rim (such as those occurring in the execution of a dunk shot.)

5 Claims, 14 Drawing Figures

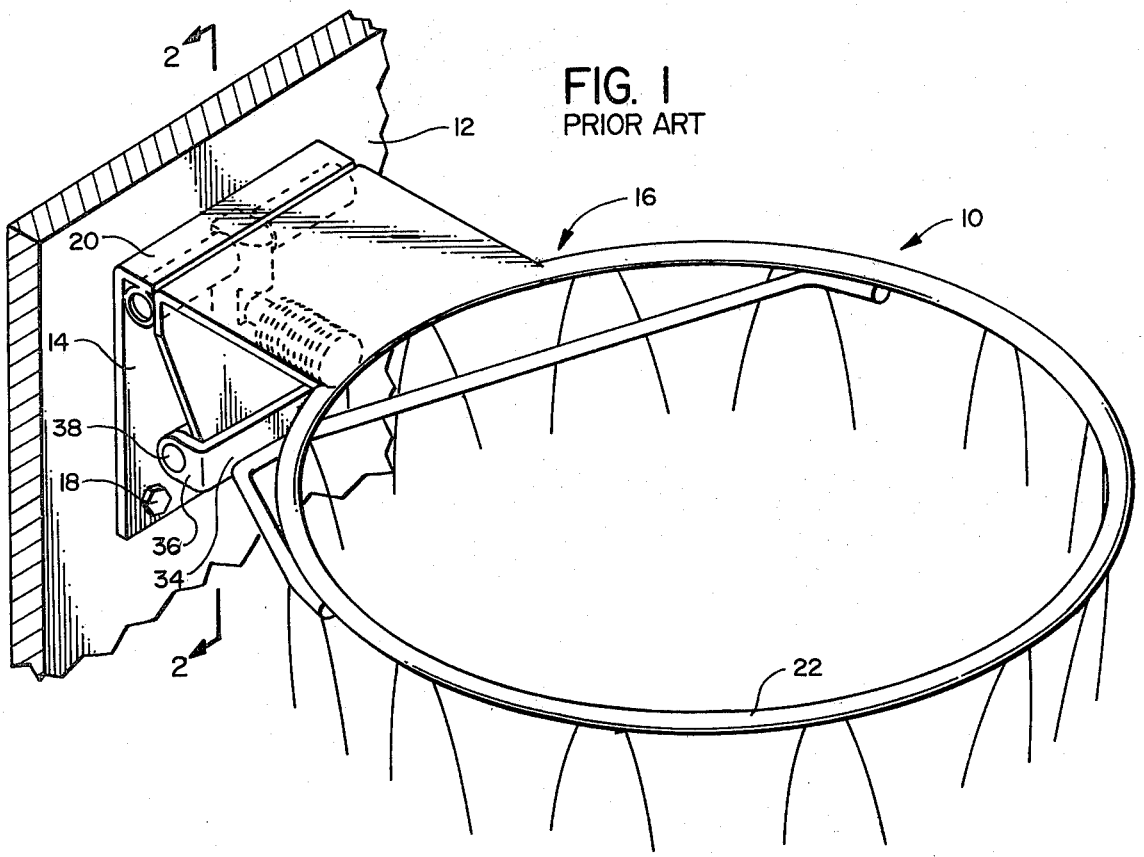
FIG. 1
PRIOR ART
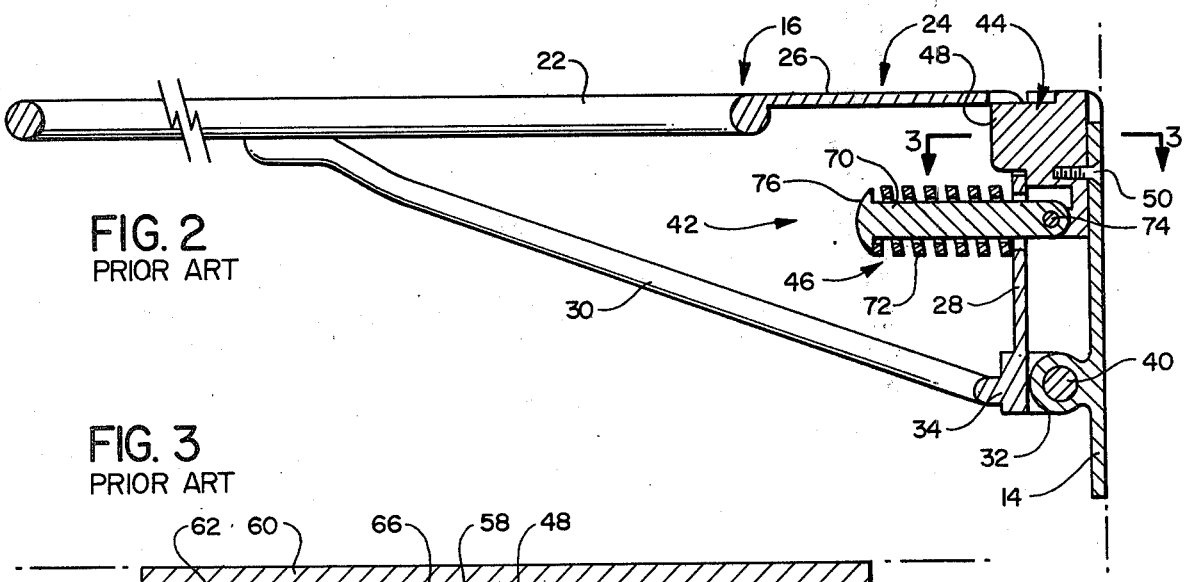
FIG. 2
PRIOR ART
FIG. 3
PRIOR ART
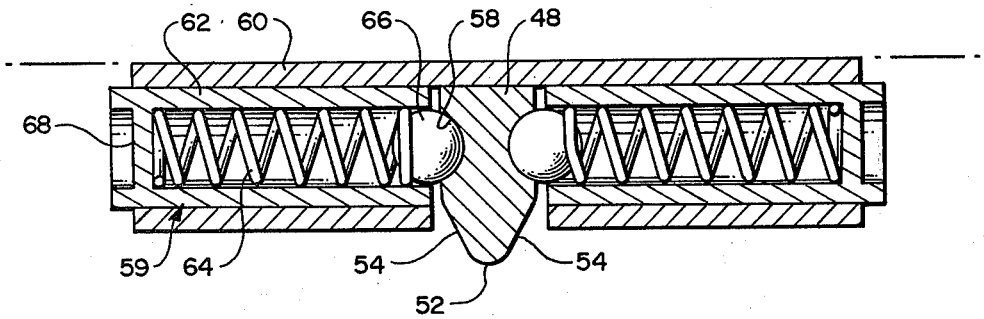

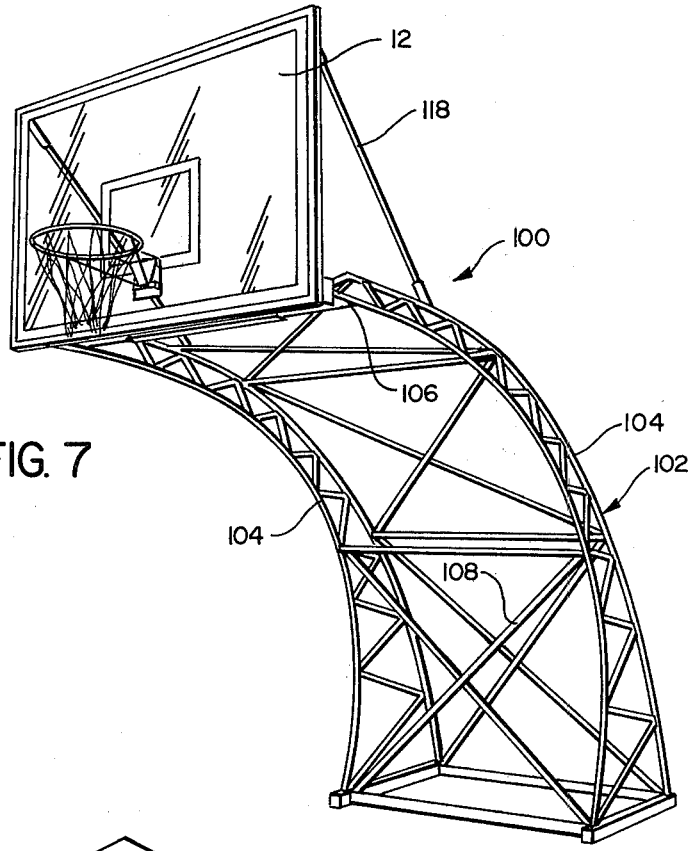
FIG. 7
FIG. 8
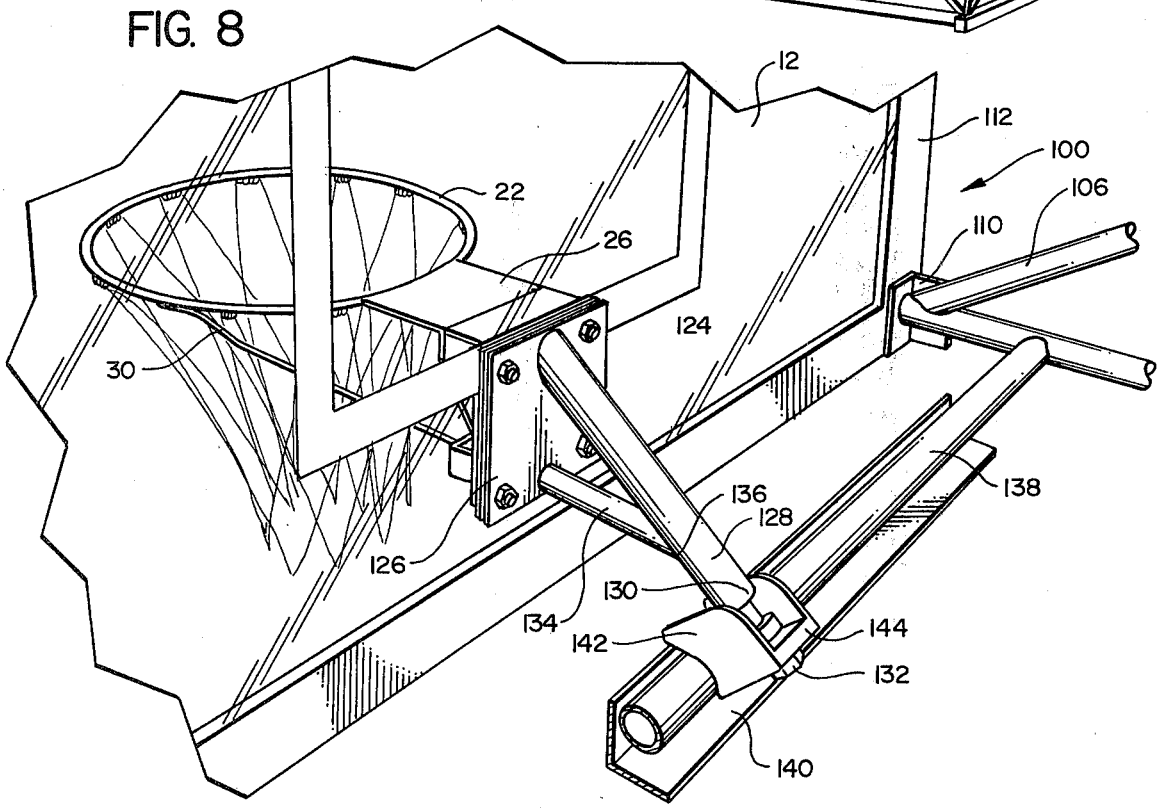

BASKETBALL RIM ASSEMBLY

BACKGROUND OF THE INVENTION

The present invention relates to basketball rim assemblies, and particularly to such assemblies designed to alleviate excessive loads applied to the rim.

One of the problem areas in modern day basketball is the abuse to which a basketball rim and backboard may be subjected, when a player executes a "dunk" shot. In some instances, when the player has completed the dunk shot and is falling toward the ground, the player will grab the rim to retain his balance or possibly break the fall. Also, it sometimes happens that the player will subject the rim to considerable impact loads in the execution of the dunk shot by the player slamming his arms downwardly against the rim as he is thrusting the ball downwardly through the hoop.

In some instances the forces exerted on the rim by the various executions of the dunk shot cause the rim itself to deform. A more serious problem is that the glass backboard to which the rim is mounted will sometimes shatter under the forces resulting from the dunk shots. To alleviate this problem, there have been proposed various release devices which permit the backboard to move away from its support structure to cushion the impact of the load. One approach to alleviate this problem has been to mount the rim to the backboard by means of a spring mounting that urges the rim to be held in its horizontal playing position. When a downward force is exerted on the rim sufficient to overcome the force of the spring, this spring deflects downwardly. When the downward force is released (e.g. by the player who has grasped the rim releasing the rim from his grip), the spring causes the basket to return to its playing position. The rim assembly can be provided with damping means to cushion the movement of the rim back to its return position.

There are yet other devices which have a mechanical release system in addition to a return spring. In such devices, the release mechanism rigidly holds the hoop or rim in its playing condition until a downward force of a predetermined magnitude is exerted on the rim. Then the mechanical release gives way, permitting the hoop to rotate downwardly, after which the spring returns the hoop to its horizontal playing position.

While such devices have greatly alleviated the problems encountered from the impact forces exerted on the rim, the problems are not solved totally. It is desirable that the release mechanism be arranged so that it will not give way until there is a fairly substantial downward load on the rim (e.g. possibly a two hundred pound downward force on the front of the rim), since the rim must be held with sufficient rigidity so as to have proper rebound characteristics. In fact, under the current rules of the National Collegiate Athletic Association, the releasable rim is required to sustain a downward force of up to 230 pounds before giving way. Also, it is not desirable to have the rim release under rather small impact loads, since this might be somewhat disruptive of normal game play. Thus, even though the impact loads are alleviated to a large extent, the repetition of these impact loads still has a weakening effect on the backboard. Thus it is still possible for backboards to shatter, even though release mechanisms are employed. With glass backboards which are commonly in use today, the shattering of the board is associated with a certain amount of danger, since it results in a scattering of glass fragments in the playing area. Also, the clean-up and replacement of the board can cause a very long delay in the game.

Further, the basketball rims with release mechanisms are relatively expensive, and thus beyond the reach financially of many institutions that provide basketball hoops (e.g. high schools, boys' clubs, YMCA's and similiar organizations). In those situations, there is a strong need to somehow provide the basketball rim assembly with means to prevent the impact forces on the rim from transmitting destructive forces into the backboard to cause the backboard to break or shatter.

In view of the foregoing, it is an object of the present invention to provide a basketball rim assembly that alleviates to a substantial extent the effect of impact forces on the rim imparting destructive forces into the backboard, which rim assembly is well adapted to be used with releaseable rims, and also adapted to be used with rims not having a release mechanism.

It is a further object to provide such an assembly which can utilize as part of the assembly conventional components of rim assemblies already in existence.

SUMMARY OF THE INVENTION

The basketball rim assembly of the present invention comprises a main support frame and a backboard which has a front surface, a rear surface, and a hoop mounting location at the front surface. The backboard is adapted to be mounted in a playing position to the main support frame. There is a hoop adapted to be mounted in a playing position at the hoop mounting location.

There is hoop support means adapted to be operatively connected between the hoop and the main frame to provide support for the hoop, to resist forces which may be exerted on the hoop to rotate the hoop downwardly from the hoop mounting location, and to transmit at least a portion of said forces directly into the main support frame without imposing said portion of the forces into the backboard. Desirably, the hoop support means comprises an upper support portion and a lower support portion, both of which are attached to the hoop. Additionally, there is a third support portion connected between the main frame and the first and second support portions, with the first and second support portions being arranged to transmit a force couple resulting from a downward force on the hoop into the third portion, substantially independently of the backboard, with a force couple being resisted in the main frame.

In this specific form herein, the first and second portions are located forwardly of the backboard, and the third portion is located rearwardly of the backboard, with the third portion being interconnected with the first and second portions through the backboard.

In some embodiments, the third support portion comprises an upper tension member arranged to resist an upper force component of said force couple and connected to the first upper support portion, and a lower compression member adapted to resist a second lower force component of the force couple and operatively connected to the lower support portion.

Specifically, there is a front plate at the front surface of the backboard at the mounting location, and a backplate positioned rearwardly of the backboard. The front plate and rear plate are connected to one another through the backboard. In some embodiments, the backplate extends downwardly to a support member of the main frame to resist vertical loads thereon. In some embodiments, the backplate is positioned to press against the backboard, so that forward loading on the backplate is transmitted at least partly into the backboard. In other embodiments, the backplate is spaced from the backboard to isolate loads on the backplate from the backboard.

In one preferred embodiment, the main frame comprises a perimeter frame extending about a perimeter portion of said backboard. The backplate is mounted to a lower member of said perimeter frame.

Other specific features of the present invention will become apparent from the following detailed description.

BRIEF DESCRIPTION OF THE DRAWINGS

FIG. 1 is an isometric view of a releasable basketball rim, presently existing in the prior art, but used in the combination of the present invention;

FIG. 2 is a side elevational view of the rim of FIG. 1;

FIG. 3 is a sectional view taken at line 3—3 of FIG. 2;

FIG. 7 is an isometric view of a rim assembly of the present invention;

FIG. 8 is an isometric view of the assembly of FIG. 7, looking rearwardly and downwardly toward the rim;

DESCRIPTION OF THE PREFERRED EMBODIMENTS

Figure 4:
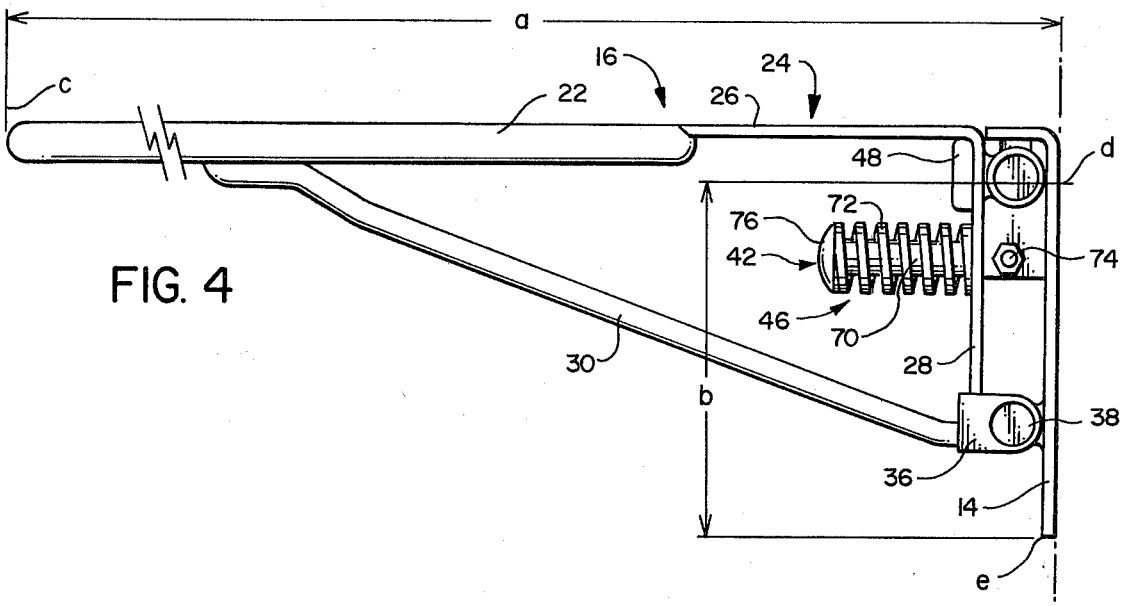
FIG. 4 is a side elevational view of the rim of FIG. 1 in its playing position.

Reference is now made to FIGS. 1 thru 6, which illustrate a releaseable rim assembly 10 which exists currently in the prior art. This assembly 10 comprises a base plate 14 and a releasable rim member 16. The base plate 14 is a flat generally rectangular metallic piece fixedly secured to the backboard 12 by means of four bolts 18 at the corners of the base plate 14. Extending a short distance forwardly from the upper edge of the base plate 14 is a short overhanging flange 20.

The rim member 16 comprises a circular hoop 22 and a mounting bracket 24 that supports the hoop 22. This bracket 24 comprises a horizontal flange 26 fixedly connected to the rear hoop 22, and a vertical flange 28 that extends downwardly from the rear edge of the horizontal flange 26. A pair of support arms 30 are connected to side portions of the hoop 22 and extend downwardly to the lower part of the vertical flange 28.

The lower edge portion of the mounting bracket 24 is hinge mounted at 32 to the lower part of the base plate 14. In the particular arrangement shown herein, this hinge mounting 32 comprises a mounting arm 34 welded to the vertical flange 28 and having a pair of rearwardly extending ears 36 that receive a hinge pin 38. The pin 38 is in turn mounted in a sleeve 40 that is welded to the base plate 14.

The release mechanism is generally designated 42, and it comprises a releasable connecting means 44 and also a cushioning and return spring 46. The releasable connecting means 44 comprises a bayonet member 48 that is fixedly connected by a retaining screw 50 to the upper middle part of the forward face of the base plate 14. This bayonet member is symmetrically shaped relative to a vertical plane passing through its horizontal, longitudinal center axis. It has a forward moderately blunt nose portion 52 and two vertical slanting faces 54 that extend rearwardly and divergently from the nose portion 52. The rear edges of the faces 54 lead into two lateral, rearwardly extending side surfaces 56 which are parallel to one another. A pair of recesses or detents 58 are formed one in each side surface 56.

In addition to the bayonet member 48, the releasable connecting means 44 also comprises a second connecting member 59 in the form of a pair of spring-loaded retaining elements 60. Each of the elements 60 comprises a horizontally and laterally extending retaining sleeve 62 in which is located a related compression spring 64 and a related retaining ball member 66 at the inner end of the sleeve 62. The outer end of each sleeve 62 is closed by an end wall 68, while the inner end of each sleeve 62 is open. The two sleeve members 62 are axially aligned and face one another, and their inner edges are spaced from one another by a distance moderately greater than the width of the bayonet member 48. The two compression springs 64 urge their respective ball members 66 inwardly toward one another.

As can be seen more clearly in FIG. 3, when the rim member 16 is in its horizontal playing position, the two spring-loaded retaining elements 60 are positioned on opposite sides of the bayonet member 48 so that the two ball members 66 are positioned in respective detents 58. When a sufficiently large downward force is exerted on the forward part of the hoop 22, the two ball members 66 are moved out of the detents 58 to permit the rim member 16 to swing downwardly.

The cushioning and return spring means 46 comprises a stud member 70 around which is mounted a coil spring 72. The stud member 70 is pivotally mounted at its rear end to a horizontally extending bolt 74 that is in turn mounted to the lower portion of the bayonet member 48. This permits limited up and down swing movement of the stud member 70. The stud member 70 extends forwardly from the bolt 74 through an opening in the flange 28 and has at its forward end a retaining head 76. The coil spring 72 bears against the retaining head 76 and the adjacent forward surface of the vertical flange 28 of the bracket 24 to urge the flange 28 rearwardly, thus urging the rim member 16 toward its horizontally aligned playing position.

Figure 5:
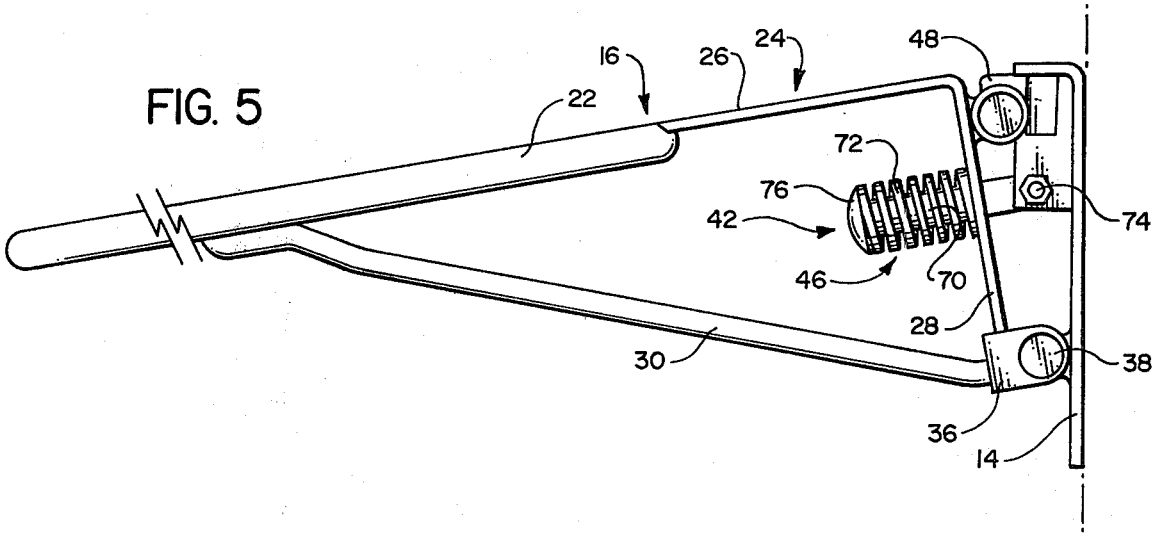
FIG. 5 is a view similar to FIG. 4, but showing the rim in a release position and moving part way to its furthest down position.
Figure 6:
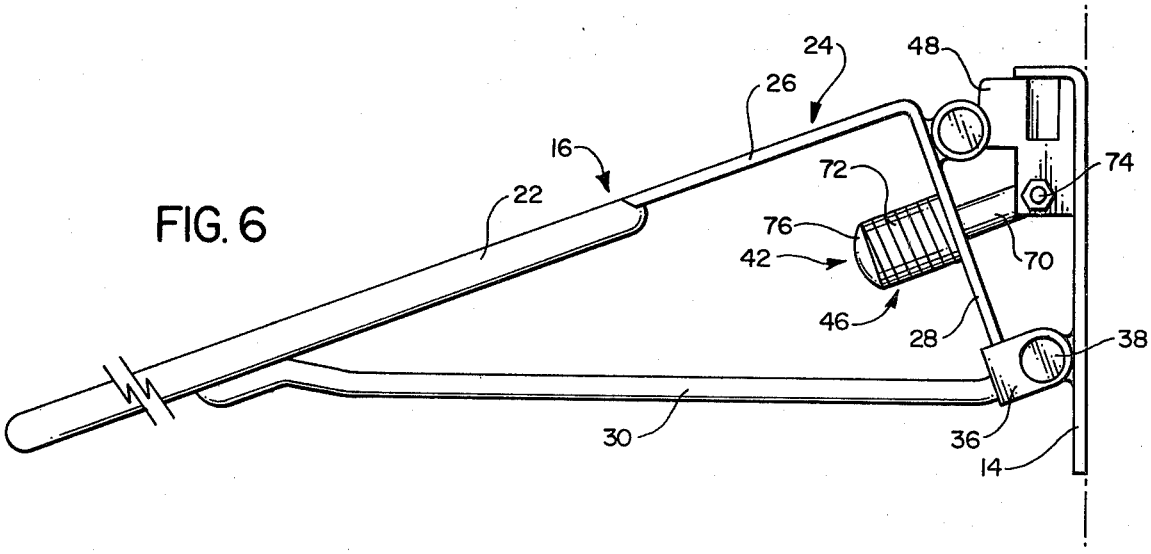
FIG. 6 is a view similar to FIG. 5 showing the rim of FIGS. 4 and 5 at its full down position.

In normal game play, the rim assembly 10 is in the position shown in FIGS. 1 and 2. When a downward force of sufficient magnitude is exerted on the rim 22, the spring loaded retaining elements 66 are moved out of their detents 58 to permit the hoop 22 to swing downwardly as shown in FIGS. 4, 5 and 6. When the hoop 22 is released by the player performing a dunk shot (or is relieved from the downward load which might be imposed in some other manner), the spring 72 causes the hoop 22 to return to its horizontal playing position.

While the mechanism described above has proven to be particularly effective in relieving impact loads on the rim assembly, it should be recognized that substantial loads are still imparted into the backboard 12. Let it be assumed that the release mechanism 42 is set so that a downward force on the front of hoop 22 modereately in excess of 200 pounds would cause the mechanism to release. Let it further be assumed that the distance "a" (indicated in FIG. 4) from the front of the hoop to the front surface of the backboard is about 24 inches, and that the vertical distance (indicated at "b") from the bottom edge of the base plate 14 (indicated at "e" in FIG. 4) to the location of the upper bolts holding the plate 14 (indicated at "d" in FIG. 4) is about 6 inches, this dimension being indicated at "b" in FIG. 4. The effect of this is to develop a force couple where there is a downward force at "c" of at least 200 pounds, and a vertically upward force at "d" exerted by the backboard against the rim, also of at least 200 pounds, with the distance between the two forces being about 24 inches. This force couple must be resisted by a second force couple, made up of a first force at location "d", which is exerted as a tension load on the upper bolts and imparted into the backboard, and also made up of an oppositely directed force at "e" which tends to push the bottom edge of the plate 14 into the backboard. Since the distance between these two forces (indicated at "b") is substantially smaller (i.e. one quarter of the distance at "a"), the forces at "d" and "e" are approximately 800 pounds each, and these are opposite one another.

While glass blackboards can normally resist loads of this magnitude, there is still the effect of repeated impact loads degrading the integrity of the structure. Further, some of the impact loads can be made somewhat more severe since they are not directed always in a straight downward direction. Some of these loads are imparted in such a manner so as to attempt to twist the rim away from the backboard. Thus, the unit loading at any one location on the board may be greater than that which would normally be imparted with a straight downward force.

With the foregoing in mind, the preferred embodiments of the present invention will now be described. Since the present invention is particularly adapted to be used in combination with the rim components shown in FIGS. 1 thru 6, the assembly of the present invention will be shown utilizing the components shown in FIGS. 1 thru 6.

Figure 9:
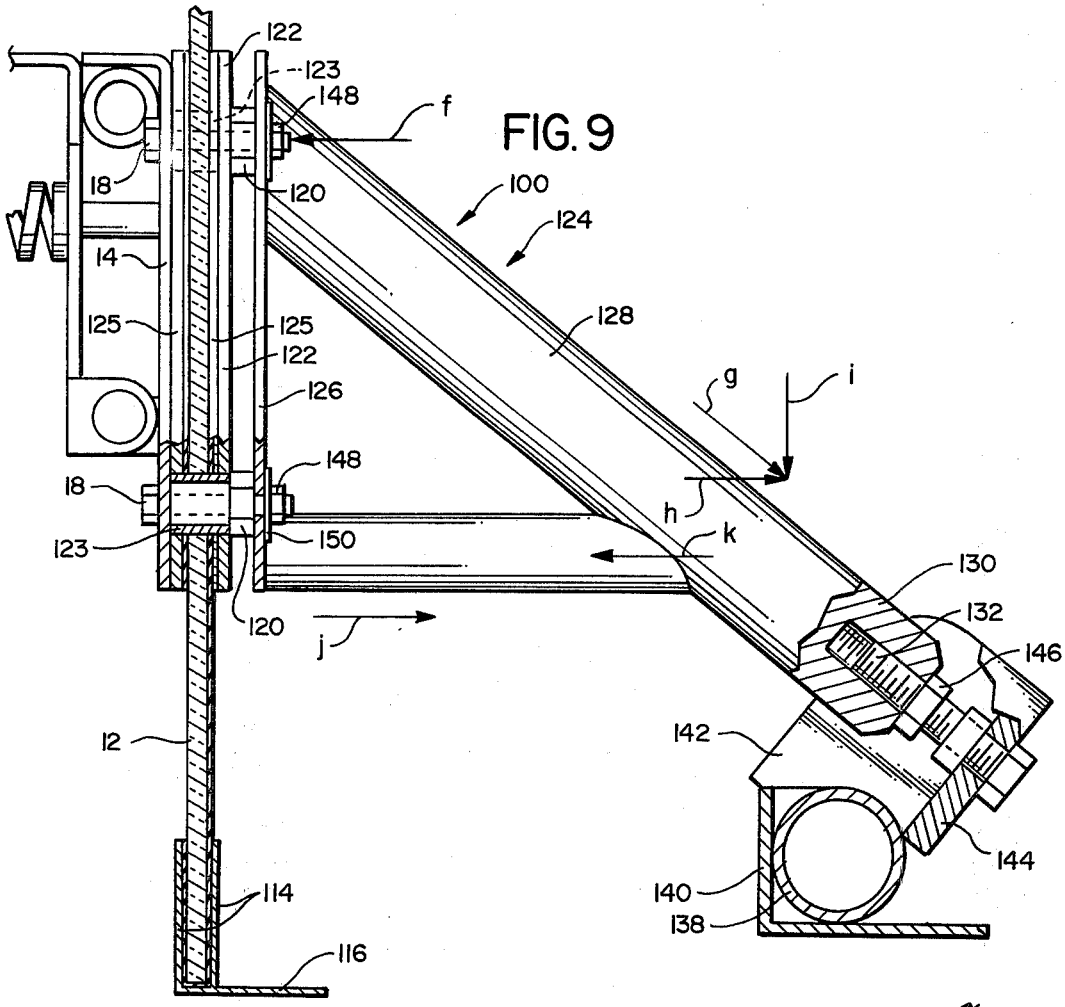
FIG. 9 is a sectional view looking toward the side of the support portion of the assembly of FIGS. 7 and 8.

A first embodiment of the rim assembly of the present invention is shown at 100 in FIGS. 7, 8 and 9. There is a base frame 102 adapted to be positioned on the playing floor. The particular frame 102 shown herein already exists in the prior art, and while this is presently the preferred frame to be used with the present invention, it will be readily apparent to those skilled in the art that other types of base frames could be used (e.g. even frames which would be suspended from an overhead support). The frame 102 comprises two substantially identical legs 104 which extend upwardly and forwardly in a curve to terminate at a front board mounting location 106. The two legs 104 are rigidly interconnected by reinforcing structure which is simply indicated generally at 108.

The front leg portions 106 are connected by brackets 110 to the lower outside corner portions of a perimeter frame 112 in which the backboard 12 is mounted. Commonly, this frame 112 is made of lightweight extruded aluminum and comprises a pair of inwardly extending spaced flanges 114 that define a receiving slot for the edge of the board 112. As shown herein, the frame 112 also has a rearwardly extending flange 116 which provides reinforcing structure. To position the frame 112 and its contained backboard 12 vertically in the playing position, there are a pair of support arms 118 interconnecting the upper side portions of the frame 112 with the base frame legs 104 at a location a moderate distance rearwardly of the mounting locations 106.

Normally, the plate 14 is mounted to the backboard 12 by means of the aforementioned bolts 18 which extend through holes in the backboard 12, with nuts 120 being threaded onto each of the bolts 18. Also, a backplate 122 commonly placed against the rear surface of the board 12, with the bolts 18 extending also through the backplate 122 and the nuts 120 pressing the backplate 122 against the rear surface of the board 12. A sheet of a moderately yielding material can be placed on the front and rear surfaces of the backboard between the plates 14 and 122. Each of the bolts 18 has a surrounding collar 123 which fits within the holes in the plates 18 and 122 and in the backboard 12.

It is to be understood that the components 102 thru 123 described above already exist in the prior art. The components which will now be described below have been added to the above described prior art components to form the unique combination of the present invention. There is a first support member 124 which is made up of a flat rectangular metal plate 126 having generally the same dimensions as the aforementioned plate 122. This plate 126 is provided with through holes at the locations of the four corners to receive the ends of the aforementioned bolts 18. There is an arm 128 (in the form of a metallic tubular member) having its forward end rigidly attached to the upper middle portion of the plate 126. This arm 128 extends downwardly and rearwardly at a moderate slant and has its rear end 130 formed with a threaded socket 131 to receive a bolt 132.

Also, there is a second arm 134 which has its forward end rigidly attached to the lower middle portion of the plate 126. This arm 134 extends horizontally with its rear end 136 rigidly attached to the lower portion of the arm 128 at a location moderately forward of the threaded socket 131. It is easily recognized that the two arms 128 and 134 form with the support plate 126 a rigid triangular member.

Extending between the two legs 104 at a location approximately one foot rearwardly of the backboard 12 is a laterally and horizontally extending tubular support member or bar 138. This tubular bar 138 has welded thereto a reinforcing member, which as shown herein is a piece of angle iron 140. Welded to the bar 138 and angle iron 140 at a central location is a U-shaped mounting bracket 142. The base portion 144 of the bracket 142 is formed with a thru hole to receive the bolt 132. A pair of nuts 146 are threaded onto the bolt 132 at a location intermediate the base portion 144 and the rear end 130 of the arm 128.

The plate 126 is positioned so that the ends of the four bolts extend through the corresponding holes in the plate 126, and the plate 126 is held firmly against the nuts 128 by means of four nuts 148 (and associated lock washers) 150 which are threaded onto the ends of the bolts 18. The bolt 132 is turned so that the arm 128 is pre-tensioned to a moderate degree, and the nuts 146 are threaded to fit snugly, one against the bracket base portion 144 and one against the end 130 of the arm 128. It is readily apparent that the plate 14, the plate 122 and the plate 126 are locked together in what is substantially a unitary structure, with the backboard 12 sandwiched between the two plates 14 and 122.

To describe the operation of the present invention, let it be assumed that with the components positioned as shown in FIGS. 7, 8 and 9, there is a substantial downward force exerted on the forward part of the rim 22, with this force not being sufficient to cause the release mechanism 42 to give way. As indicated previously, with the prior art arrangement, this would cause a force couple to be applied through the plate 14 to the backboard 12. However, in the present invention, this does not occur. With reference to FIG. 9, the upper force component of that force couple is indicated at "f", and this is resisted by the two upper bolts 18 pulling against the rearmost plate 126. This force component "f" is translated as a tension load (indicated at "g" in FIG. 9) into the arm 128. (For ease of illustration, this tension load is shown as being directed alongside of the arm 128, it being understood that this force would be acting through the center of the arm 128 to the bar 138.) This tension force "g" is resisted in the bar 138 and angle iron 140, and force "g" can be considered as being broken into two force components, namely a horizontal component "h", and a vertical component "i".

The lower part of the force couple which would be exerted at point "e" (with reference to FIG. 4), is reacted thru the plates 14, 122 and 126 and results in a compression force being exerted on the horizontal arm 134, this force being indicated at "j" in FIG. 9. (As shown in FIG. 9, the force component "j" is shown as positioned below the arm 134, it being understood that it is reacted approximately through the longitudinal center axis of the arm 34 and transmitted through the lower portion of the arm 128). This force component "j" is resisted by a force component "k" exerted from the arm 128. The net effect is that the horizontal force components "f", "h", "k" and "j" substantially cancel each other out, and the result is that the substantial horizontally directed force couple which was exerted in the prior art device at points "d" and "e" (described with reference to FIG. 4) is eliminated. Thus, the backboard 12 has only applied to it a substantially vertical force component which lies within and generally parallel to the plane of the backboard 12. In addition, the frictional engagement of the two plates 14 and 122 gripping the backboard 12 alleviate a good deal of the concentrated loading which would otherwise be transmitted through the collars 123 into the backboard 12.

Figure 10:
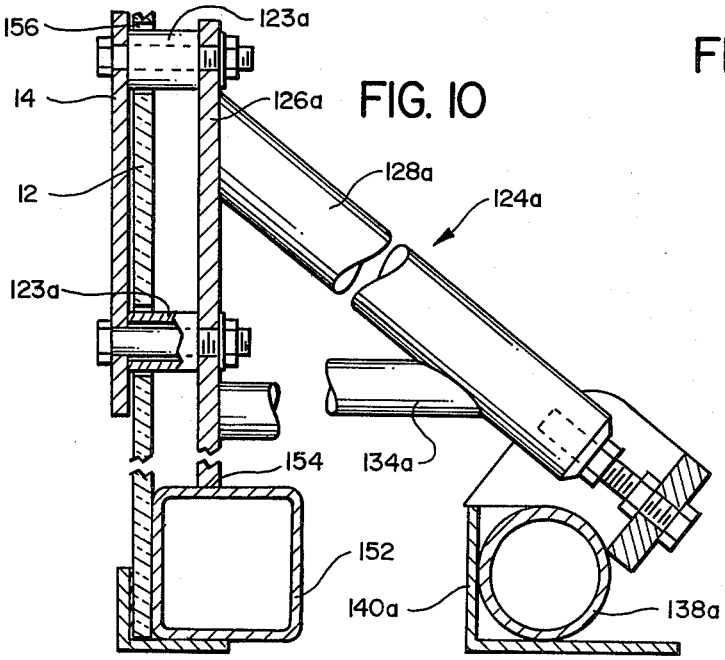
FIG. 10 is a view similar to FIG. 9, showing a second embodiment of the present invention.
Figure 11:
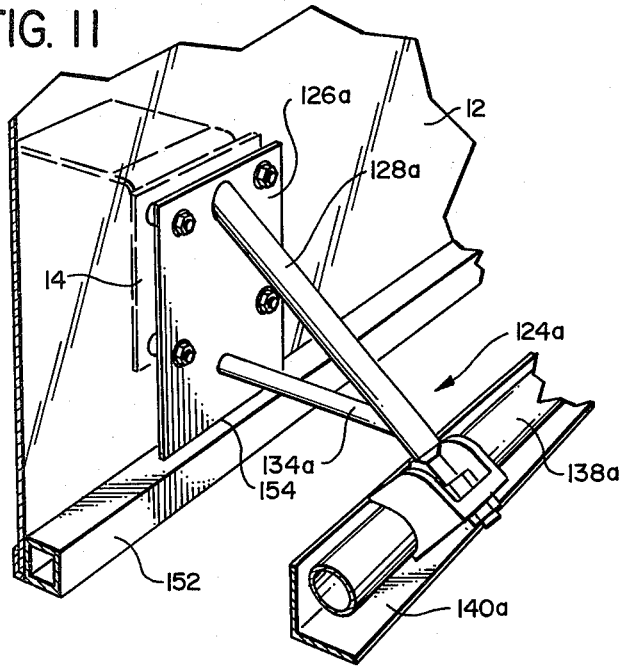
FIG. 11 is an isometric view looking downwardly toward the rear of the embodiment shown in FIG. 10.

A second embodiment of the present invention will now be described with reference to FIGS. 10 and 11. In this second embodiment, components which correspond to those described in the first embodiment will be given like numerical designations, with an "a" suffix distinguishing those of the second embodiment. As in the first embodiment, there is a support member **124*a* made up of the plate 126*a*, and arms 128*a* and 134*a*. Likewise, there is a tubular bar 138*a* and a reinforcing angle iron 140*a*. The backplate 122 of the first embodiment is eliminated, and instead, the two collars 123*a* are lengthened so that these extend the entire distance between the plate 14 and the plate 126*a***.

There is a second laterally and horizontally extending bar 152 extending between and rigidly attached to the two legs 104, and this bar 152 is positioned immediately adjacent the lower edge of the backboard 12. As shown herein, this bar 152 has a square tubular configuration. The plate **126*a* is made longer than the plate 126 of the first embodiment so that the lower edge 154 of this plate 126*a* bears against the top surface of the bar 152 and is rigidly welded thereto. Thus, it becomes apparent that any vertical loads exerted through the plate 14 and plate 126*a* will be reacted downwardly against the bar 152. The holes 156 in the backboard 12 can be enlarged slightly to prevent contact with the backboard 12**.

To describe the operation of this second embodiment, let it again be assumed that a substantial vertical load is exerted on the front of the hoop 22. The support member **124*a* functions in substantially the same manner as described with reference to the first embodiment of FIGS. 7 thru 9 so that the horizontal force components are cancelled and there is no force couple exerted against the backboard 12. The vertical force component which in the first embodiment of FIGS. 7 thru 9 was reacted through the backboard 12, is now reacted through the rear plate 126*a* into the bar 152, and in turn reacted into the legs 104 of the base frame 102. It can readily be appreciated that this arrangement substantially isolates the backboard 12 from the loads exerted on the hoop. Further, all of the additional support structure is positioned on the backside of the backboard 12 so that it does not detract from the conventional appearance of the rim 22 and backboard 12**.

Also, it will readily be recognized that in the second embodiment, the support structure for the plate 14 will resist torsional loads exerted on the hoop 22 in almost any direction. For example, if there is a substantial downward load on one side of the hoop, the twisting of the hoop downwardly on that side would be resisted as a torsional load applied directly into the plate **126*a*. Further, if there is a substantial horizontal lateral force on the hoop 22, possibly combined with a downward force, this to would result in a torsional load resisted by the plate 126*a* and transmitted into the bar 152 and tubular member 138*a***.

A third embodiment of the present invention will now be described with reference to FIG. 12. Components of this third embodiment which are similar to corresponding components of the first two components will be given like numerical designations with a "b" suffix distinguishing those of the third embodiment.

In this third embodiment, there is a horizontal bar **152*b* positioned in the same manner as in the second embodiment. There is a rear plate 126*b* substantially similar to the plate 126*a* of the second embodiment. However, this plate 126*b* is welded at the forward upper edge of the bar 152*b* so that it is positioned against the back surface of the backboard 12. The bolts 18 bear against the front plate 14 and the rear plate 126*b* so that the backboard 12 is sandwiched rigidly between these plates 14 and 126. There is a reinforcing web 156 welded to the plate 126*b* and the bar 152*b***.

Figure 12:
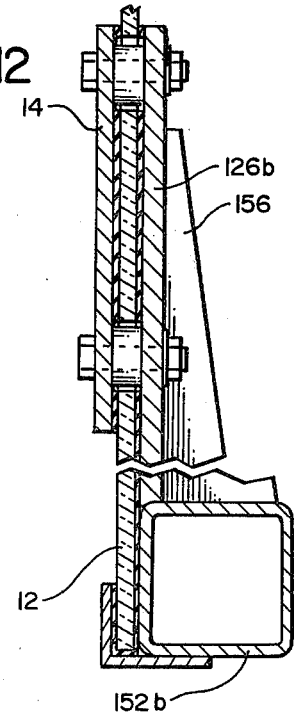
FIG. 12 is a view similar to FIGS. 9 and 10, showing yet a third embodiment of the present invention.
Figure 13:
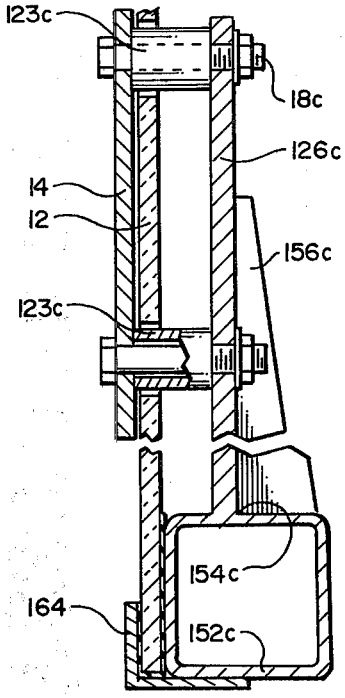
FIG. 13 is a view similar to FIG. 12, showing yet a fourth embodiment.

To examine the operation of this third embodiment shown in FIGS. 12 and 13, let it now be assumed that there is a substantial downward force on the front of the hoop or rim 22. The force couple which is exerted on the plate 14 will be imparted partially into the rear plate **126*b*, and partially into the bar 152*b*. (The rear plate 126*b* is made sufficiently strong so that it will accept these loads without any significant deformation). The vertical loads will be reacted directly by the plate 126*b* into the lower bar 152*b*. However, there will still be a tendancy for the downward force on the front of the rim 22 to rotate the entire plate 126*b* forwardly about the location of the connection of the plate 126b with the bar 152b. While the bar 152b will resist this to a large extent, the entire plate 126b will be pulled forwardly to some extent against the rear surface of the backboard 12. It is significant to note that the effect of this is to distribute this force over a relatively large portion of the surface of the backboard so that the unit loading on any one part of the backboard 12 is relatively low. Further, it is important to note that the force couple that was described previously with reference to FIG. 4 is substantially eliminated. It will be recalled that with the configuration of FIG. 4**, there was a first load tending to pull the backboard forwardly at point "d" and a second load attempting to push the backboard rearwardly at point "e". Intermediate these two points "d" and "e", the backboard was unstressed, but the unit loading was relatively high at locations "d" and "e", with the two forces exerted at "d" and "e" being opposite to one another and exerted over relatively short moment arms.

However, with the configuration of the third embodiment, the forces exerted on the board at these same points are in the same direction. Thus this entire portion of the board is in a sense pulling in the same direction to resist the force, and thus the unit loading on any one portion of the board is greatly reduced.

A fourth embodiment of the present invention will now be described with reference to FIGS. 13 and 14. Components of this fourth embodiment which are similar to components of the three previously described embodiments will be given like numerical designations, with a "c" suffix distinguishing those of the fourth embodiment. In this fourth embodiment, there is a plate 126c welded at 154c to a lower bar 152c. Also, there is a reinforcing web 156c which has a lower edge welded to the bar 152c and a vertical edge welded to the plate 126c. The bar 152c is made as a relatively rugged beam having a tubular square cross-sectional configuration. Such a beam is well adapted to resist torsional loading.

Further, surrounding the bolts 18c are collars 123c which in combination with the bolts 18c secure the backplate 126c rigidly to the front plate 14. The collars 123c and bolts 18c make the forward plate 14, the backplate 126c and the bar 152c a rigid unitary structure.

Figure 14:
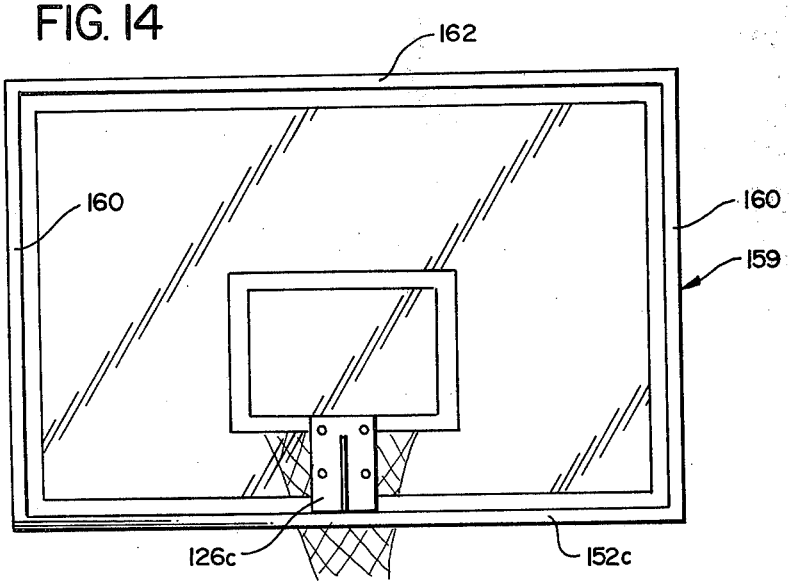
FIG. 14 is a rear elevational view of the fourth embodiment of the present invention, this view showing the full backboard of the assembly.

Reference is now made to FIG. 14, which shows the fourth embodiment from a rear elevational view, separate from the other supporting structure. The lower beam 152c is incorporated in a rectangular perimeter frame 159, made up of the bottom beam 152c, two side beams 160, and an upper horizontal beam 162. These are rigidly interconnected with one another (e.g. by welds) to form a relatively rigid frame. The cross-sectional configuration of the beam members 160 and 162 is generally the same as the construction of the beam 152c. Thus, when there are any loads exerted on the hoop 22, these are translated directly into the plate 14, to the plate 126c and thence into the main rectangular frame made up of the beams 152c, 160 and 162. If there is severe downloading on the front of the rim 22, there is some tendancy for the lower beam 152c to twist slightly, resisting such loads in torsion. However, the spacing of the rear plate 126c permits a slight forward movement of the plate 14 away from the backboard 12. It can readily be appreciated that the loads exerted on the rim are substantially totally isolated from the backboard 12. The perimeter portions of the backboard 12 are retained in a perimeter frame member 164 (shown herein as a frame with a right angle configuration) attached to the main frame 152c, 160 and 162. The frame 159 can be in turn mounted to a frame such as shown at 102 in the first embodiment, from an overhead mounting structure or possibly some other structure.

It will be evident to those skilled in the art that the particular configurations described above are given by way of example and are not intended to be limiting. It will be readily apparent that various changes in the support structure could be employed while still employing the basic principles of the present invention. Further, it will be appreciated that while the present invention has been described in combination with a basketball rim having a release mechanism, it could also be very advantageously applied to conventional basketball rims not having such a mechanism.

What is claimed is:

1. A basketball rim assembly comprising:

(a) a backboard of a generally conventional planar configuration with a front surface, a rear surface, and a perimeter portion, said backboard having a set of circular through mounting holes at a rim mounting location, said through mounting holes being spaced from one another and each having a first diameter;

(b) a basketball rim having a generally conventional configuration and comprising a circular rim member with a front portion and a rear portion, and a mounting portion comprising a vertical front mounting plate positioned generally coplanar with and proximate to the front surface of the backboard at the mounting location;

(c) a unitary rigid force transfer means for absorbing and distributing forces exerted on said basketball rim, said force transfer means including backboard support members supporting said backboard, a horizontally extending bar affixed to said backboard support members and positioned immediately adjacent to said backboard, a vertically oriented rear mounting plate positioned at said mounting location, said rear mounting plate having a planar surface located adjacent to and spaced from said backboard, said rear mounting plate being rigidly affixed to said horizontally extending bar at a lower edge of said rear mounting plate, and a plurality of connecting members rigidly connected between said vertical front mounting plate and said rear mounting plate, said connecting members each having a maximum dimension less than said first diameter to define a clearance between the surface of said connecting members and said backboard, each connecting member being positioned to extend through a respective one of the through mounting holes in the backboard, with the connecting members thus being arranged in a configuration matching the configuration of the through holes in the backboard and said connecting members securing said front mounting plate to said rear mounting plate with said backboard being located therebetween, said force transfer means absorbing forces exerted on said basketball rim by transferring such forces to said horizontally extending bar via said connecting members, said rear mounting plate, and from said horizontally extending bar to said backboard supporting members thereby preventing those forces from being applied to said backboard.

2. The basketball assembly defined in claim 1, further including a frame member affixed to a lower edge of said backboard and wherein said horizontally extending bar is rectangular in cross-sectional configuration and has one side thereof abutting said backboard and another side thereof abutting said frame.

3. The rim assembly as recited in claim 1, wherein each connecting member comprises an elongate fastener and a related collar which surrounds its related elongate fastener and is located in a related one of the through holes in the backboard.

4. The rim assembly as recited in claim 3, wherein each fastener is a tension member having a head end and a threaded end and a related nut member, said fastener pulling the front plate and the rear plate toward one another, the collar of each connecting member butting against a rear surface of the front plate and against a forward surface of the rear plate to position the front plate and the rear plate relative to one another in a desired position and to form a rigid interconnection between the front plate and the rear plate.

5. A basketball rim assembly comprising:

(a) a backboard of generally conventional planar configuration with a front surface, a rear surface, and a perimeter portion, said backboard having a set of circular through mounting holes at a rim mounting location, said through mounting holes being spaced from one another and each having a first diameter;

(b) a basketball rim having a generally conventional configuration and comprising a circular rim member with a front portion and a rear portion, and a mounting portion comprising a vertical front mounting plate positioned generally coplanar with and proximate to the front surface of the backboard at the mounting location;

(c) a unitary rigid force transfer means for absorbing and distributing forces exerted on said basketball rim, said force transfer means including backboard support members supporting said backboard, a frame on said backboard, a torsion bar affixed to said frame and positioned immediately adjacent to and spaced from said backboard, a vertically oriented rear mounting plate positioned at said mounting location, said rear mounting plate having a planar surface located adjacent to and spaced from said backboard, said rear mounting plate being rigidly affixed to said torsion bar, a plurality of connecting members rigidly connected between said vertical front mounting plate and said rear mounting plate, said connecting members each having a maximum dimension less than said first diameter to define a clearance between the surfaces of said connecting members and said backboard, each connecting member being positioned to extend through a respective one of the through holes in the backboard and securing said front mounting plate to said rear mounting plate with said backboard being located therebetween, said force transfer means absorbing forces exerted on said basketball rim by transferring said forces to said torsion bar via said connecting members and said front and rear plates, and to said frame via said torsion bar and from said frame to said backboard support members thus preventing those forces from being applied to said backboard.

* * * * *